US005918989A

United States Patent [19]

Stout, Jr. et al.

[11] Patent Number: 5,918,989

[45] Date of Patent: Jul. 6, 1999

[54] HAND HELD LABEL PRINTER SPOOL

[75] Inventors: Robert E. Stout, Jr., Richfield; Robert F. Behlmer, Wauwatosa, both of Wis.

[73] Assignee: Brady Worldwide, Inc., Milwaukee, Wis.

[21] Appl. No.: 09/033,215

[22] Filed: Mar. 2, 1998

[51] Int. Cl.[6] ..... B41J 3/36; B65H 75/14

[52] U.S. Cl. ..... 400/88; 400/613; 242/563

[58] Field of Search ..... 400/613, 703, 400/88; 242/563

[56] References Cited

U.S. PATENT DOCUMENTS

| | | | |
|---|---|---|---|
| 4,264,396 | 4/1981 | Stewart | 156/361 |
| 4,407,692 | 10/1983 | Torbeck | 156/350 |
| 4,440,248 | 4/1984 | Teraoka | 177/4 |
| 4,473,426 | 9/1984 | Goodwin et al. | 156/384 |
| 4,477,305 | 10/1984 | Hamisch, Jr. et al. | 156/384 |
| 4,490,206 | 12/1984 | Makley | 156/384 |
| 4,497,682 | 2/1985 | Hamisch, Jr. | 156/384 |
| 4,498,947 | 2/1985 | Hamisch et al. | 156/384 |
| 4,501,224 | 2/1985 | Shibayama | 118/697 |
| 4,511,422 | 4/1985 | Hamisch et al. | 156/384 |
| 4,544,434 | 10/1985 | Mistyurik | 156/384 |
| 4,556,442 | 12/1985 | Torbeck | 156/350 |
| 4,584,048 | 4/1986 | Hamisch et al. | 156/384 |
| 4,630,538 | 12/1986 | Cushman | 101/45 |
| 4,655,129 | 4/1987 | Wirth et al. | 101/35 |
| 4,680,078 | 7/1987 | Vanderpool et al. | 156/352 |
| 4,807,177 | 2/1989 | Ward | 364/900 |
| 5,015,324 | 5/1991 | Goodwin et al. | 156/384 |
| 5,078,523 | 1/1992 | McGourty et al. | 400/613 |
| 5,318,370 | 6/1994 | Nehowig | 400/613 |
| 5,372,443 | 12/1994 | Borucki | 400/649 |
| 5,494,365 | 2/1996 | Nagae et al. | 400/703 |
| 5,516,219 | 5/1996 | Leonard et al. | 400/613 |
| 5,672,020 | 9/1997 | Leonard et al. | 400/690.4 |

FOREIGN PATENT DOCUMENTS 3-238257 10/1991 Japan .

*Primary Examiner*—Edgar Burr
*Assistant Examiner*—Daniel J. Colill
*Attorney, Agent, or Firm*—Quarles & Brady LLP

[57] ABSTRACT

A hand held label printer receives spools containing print media of different sizes and types. Each spool contains a memory chip which stores information about its print media, and this information is conveyed to the printer through concentric electrical contacts on the end of the spool. The concentric electrical contacts engage stationary contacts on the printer, and this electrical connection is insensitive to incidental rotation of the spool when it is inserted into the printer and used.

7 Claims, 4 Drawing Sheets

HAND HELD LABEL PRINTER SPOOL

TECHNICAL FIELD

The field of invention is printers, and more particularly hand held label printer spools.

DESCRIPTION OF THE BACKGROUND ART

There are a number of U.S. patents that disclose electronic apparatus for printing indicia on labels, some of these are restricted to hand held units and others that disclose tabletop units. Hand held labeling machines are disclosed, for example, in U.S. Pat. Nos. 4,264,396, Stewart; 4,407,692, Torbeck; 4,473,426, Goodwin et al.; 4,477,305, Hamisch; 4,490,206, Makely 4,497,683, Hamisch; 4,498,947, Hamisch et al.; 4,511,422, Hamisch et al.; 4,544,434, Mistyurik; 4,556,442, Torbeck; 4,561,048, Hamisch et al.; and 4,680,078, Vanderpool et al. Tabletop units for this general purpose, some of which are portable are described in U.S. Pat. Nos. 4,440,248, Teraoka; 4,501,224, Shibayama; 4,630,538, Cushing; and 4,655,129, Wirth et al.

The electronic machines for printing labels of the type disclosed above all include the same general combination of elements, a print head, means for feeding labeling media to be printed past the print head, a microprocessor, a read only memory programmed with appropriate instructions to operate the microprocessor, a random access memory, a keyboard with letter, number, and function keys for the entry of alphanumeric information and instructions concerning the indicia to be printed, and a visual display such as a LED, LCD unit to assist the operator in using the machine. In a hand held printer, these components may all be enclosed in a single housing.

A particular type of print head employs thermal transfer printing technology. Thermal transfer printing uses a heat generating print head to transfer a pigment, such as wax, carbon black, or the like, from a thermal transfer ribbon on to a labeling media. By using digital technology, characters are formed by energizing a sequence of pixels on the print head which in turn melt the wax or other pigment on the ribbon transferring the image to the labeling media.

The labeling media comprises a series of labels that are attached to a carrier strip. The carrier strip is fed through the printer and images are printed on the labels. The labels are then removed from the carrier and attached to the objects needing identification. As there are many types of label applications, there are many combinations of labels and carrier strips that provide labels of varying sizes, colors and formats.

Many of the label printers of the type described above are capable of printing on labels of varying sizes and with varying formats. Care must be taken by the user, therefore, to ensure that the labeling media loaded on the printer is compatible with the printing format desired. A mismatch between the format and labeling media may result in the printer printing unusable labels with the user having no means of determining whether the problem lies in the printing machine itself, or in the labeling media, or in the incompatibility of the two.

In addition, many label printers are designed for printing on labeling media that meets certain physical criteria. A user has no way of reliably knowing whether the labeling media that has been purchased is compatible with the particular printer and meets the printer manufacturer's standards. A mismatch between the labeling media and the printing machine may cause damage to the printing machine, again with no means to determine the cause of the damage.

Generally, the label type is manually entered by the user through the printer keyboard. This provides the printer with the information required to properly print labels in the correct format. This method is subject to user error and it does not address the problem of using print media that is physically incompatible with the printer.

Methods are known in the art that address the problem of using incompatible labeling media. One approach is to provide an adjustable platen for a label printer which accommodates media of widely different widths and thicknesses as is disclosed in U.S. Pat. No. 5,372,443, Borucki et al. While this approach reduces the compatibility problem by enabling the printer to work with a wider range of print media types, the compatibility problem still exists. In addition, such mechanical measures are of no assistance in differentiating print media designed for use in thermal printers.

Another solution to the compatibility problem that is used in large printers is to provide an electronic means for the printer to identify the particular print media being used. In U.S. Pat. No. 5,318,370, Nehowig, for example, the print media is contained in a cassette and a memory chip mounted in the cassette stores information about the print media. When the cassette is inserted in the printer, this information is read by the printer and used to control its operation. This approach has not been applied to hand held printers where the print media is supplied in a roll that is supported on a removable spool.

SUMMARY OF THE INVENTION

The present invention is a spool for supporting a roll of print media used in a hand held printer. More particularly, the spool includes a cylindrical core which extends through an opening in the roll of print media and enables the print media to unwind about a roll axis as it is used by the hand held printer; hubs formed on the two ends of the cylindrical core and shaped to fit in receptacles in the hand held printer which support the spool therein; a memory chip mounted in the spool and located adjacent to one hub; two electrical contacts formed on the end of said one hub and positioned to engage two stationary contacts in one of the printer receptacles when the spool is mounted therein; and electrical connections between the two electrical contacts and the memory chip; wherein the memory chip stores information specifying the print media.

A general object of the invention is to identify the print media used in a hand held printer. When the spool is inserted in the printer receptacles, its two electrical contacts are engaged and electrically connected with the two stationary contacts that in turn couple to the printer microprocessor controller. The microprocessor controller can thus electrically interrogate and read the information stored in the memory chip to identify very precisely the print media being used.

Another object of the invention is to provide a reliable electrical connection between the spool and the microprocessor. The two electrical contacts on the end of the spool are concentric about the roll axis. As a result, regardless of the orientation of the spool as it is inserted into the printer receptacles, contact is made with the stationary electrical contacts. If during use the spool rotates as the print media unwinds, electrical connection is maintained.

Yet another object of the invention is to provide an economical means for specifying the print media carried by a spool. The spool is formed in two parts, with the core and one hub molded a one part and the other hub containing the memory chip molded as a cap that fastens to the spool. A circuit board is mounted in the end of the cap and the memory chip mounts to the inner side of this circuit board and the two electrical contacts are formed on the outer side of the circuit board.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
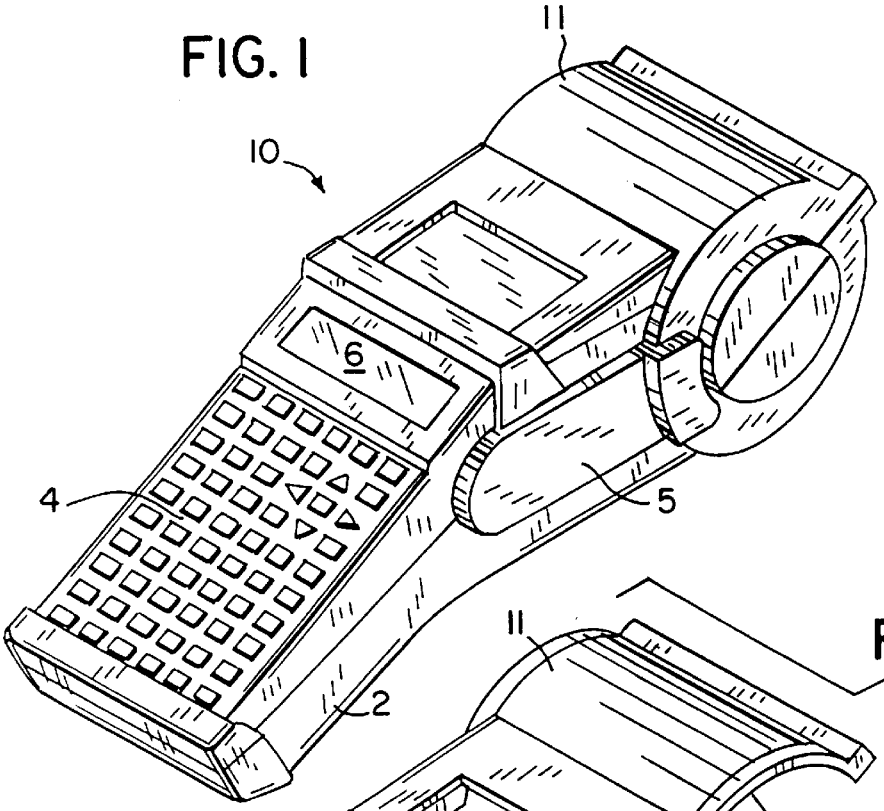
FIG. 1 is a perspective view of a hand held label printer which employs the present invention.
Figure 2:
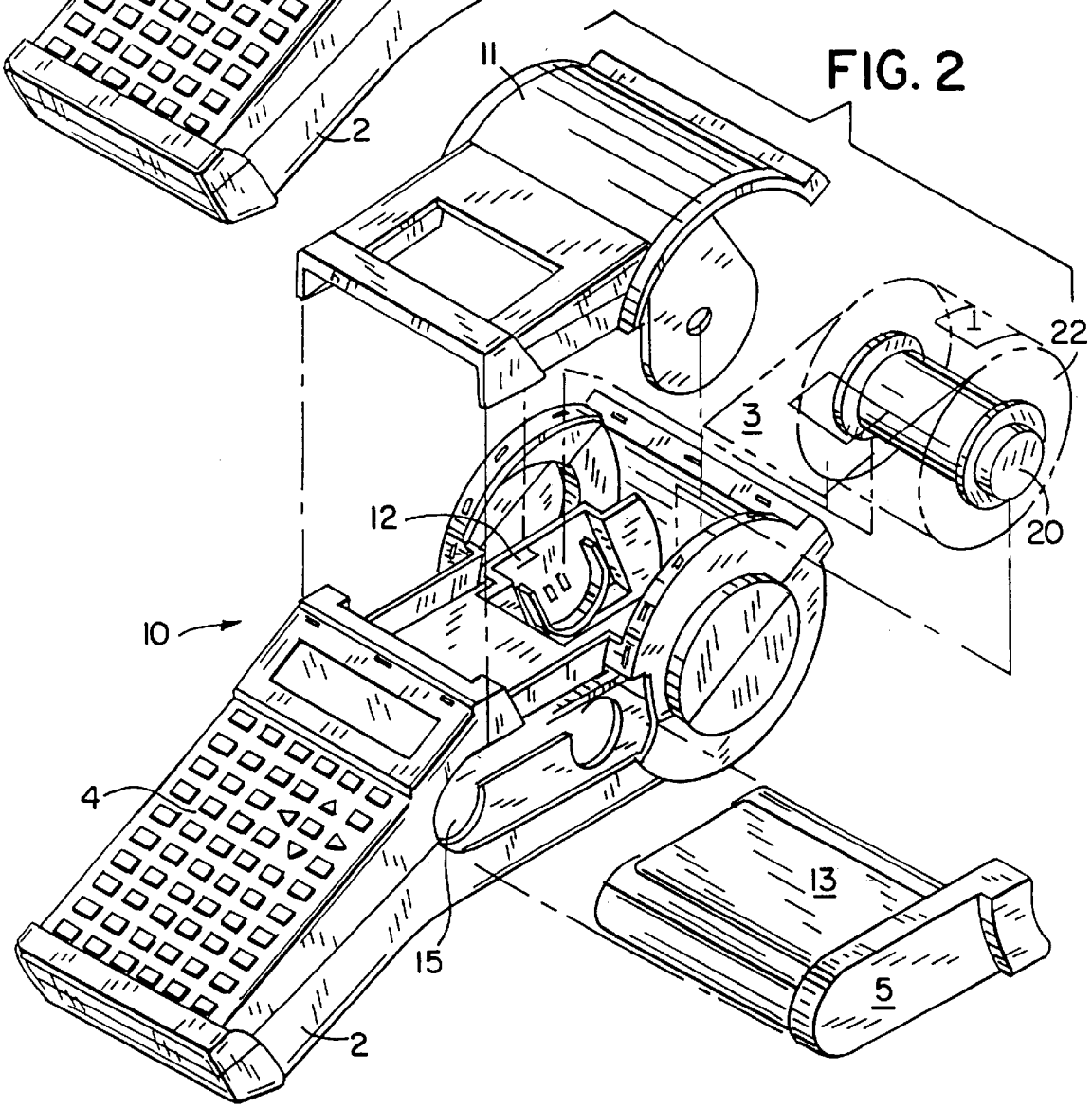
FIG. 2 is an exploded perspective view of the hand held label printer in FIG. 1.

Referring particularly to FIGS. 1 and 2, a printing machine 10 which employs the preferred embodiment of the present invention includes a molded plastic housing 2 that supports a keyboard 4 on its front surface and a display 6 positioned above the keyboard 4. The housing 2 has a cavity 12 formed in the housing 2 above the display 6 for receiving a spool 20 containing labeling media 22. The labeling media 22 is formed as a roll which is carried by the spool 20. The spool 20 is inserted into a receptacle cavity 12 and the labeling media is threaded through the printing machine 10. A cover 11 enclosing the spool 20 and labeling media 22 in the receptacle cavity 12 is pivotally mounted to the housing 2 and conceals the unused labeling media 22 from view.

The labeling media 22 is comprised of a carrier web 3 which supports a series of adhesive labels 1. The size, color, and type of label material carried by the spool 20 varies depending upon the particular print application. As the labeling media 22 is consumed by the printer, it unrolls off the spool 20 until the spool is empty.

An ink ribbon cartridge 5 having a thermal transfer ribbon 13 disposed within the cartridge 5 is inserted into a cavity 15 in the side of the printing machine 10. The ink ribbon cartridge as used with this invention is fully described in copending patent application THERMAL TRANSFER RIBBON CARTRIDGE, Attorney Docket No. 180003.93660 filed simultaneously with the present patent application and incorporated by reference herein.

Drive spindles of a stepping motor gear mechanism rotatably drive take up and supply spools of the cartridge 5 while a drive roller advances the ink ribbon and labeling media through the printing machine 10. The stepping motor gear mechanism is fully described in copending patent application METHOD AND APPARATUS FOR MAINTAINING RIBBON TENSION, Attorney Docket No. 180003.93678 filed simultaneously with the present patent application and incorporated by reference herein.

A thermal print head (not shown) in the printing machine 10 is arranged to cooperate with the thermal transfer ribbon 13 of the ink ribbon cartridge 5 and the labeling media 22 such that the print head can print characters or symbols on the labeling media. This is described in greater detail in U.S. Pat. No. 5,078,523 which is incorporated herein by reference.

Figure 3:
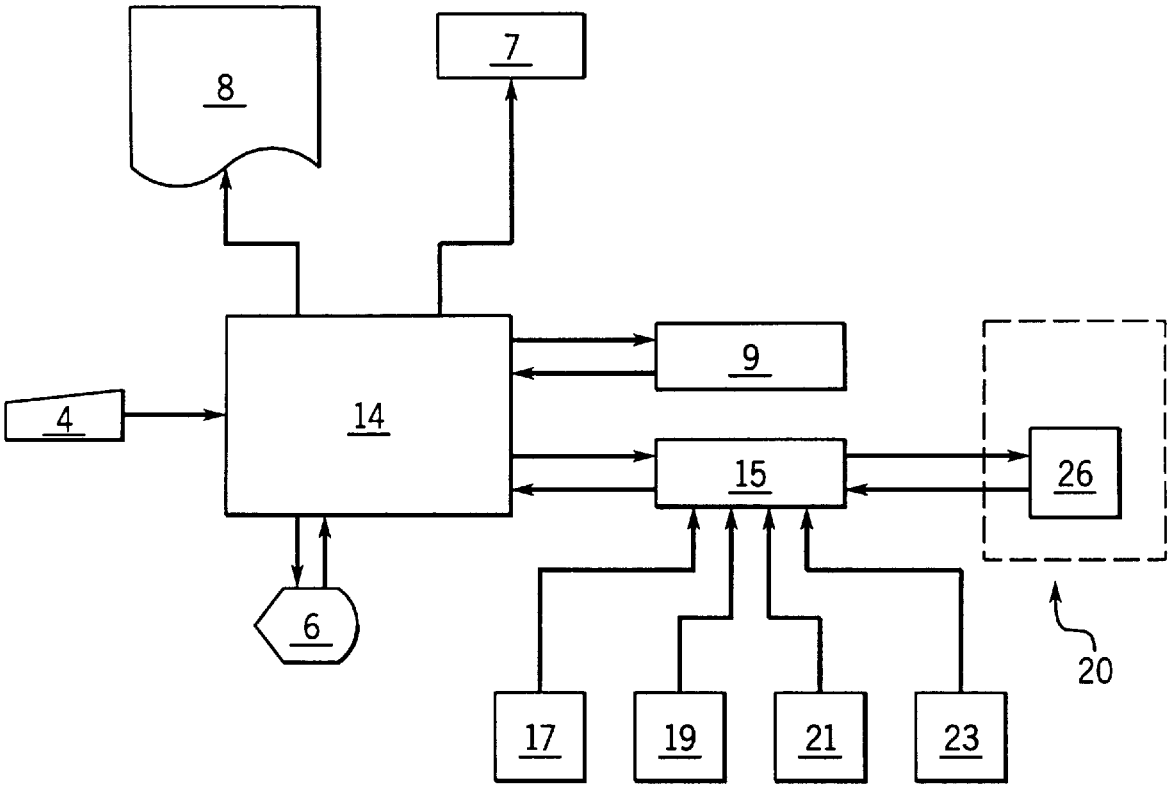
FIG. 3 is an electrical block diagram of the printer in FIG. 1.

Referring particularly to FIG. 3 the elements of the printing machine 10 are controlled by a microprocessor 14 which operates under the direction of a stored program. The microprocessor 14 couples to the key board 4 to receive manual input data from the operator of the printing machine 10 and it couples to the display 6 to prompt the operator with messages. Input data may also be received through a serial port 9 coupled to the microprocessor 14. The microprocessor 14 controls the drive motor 7 to feed the ribbon 13 and the labeling media 22 into position where a thermal print head 8 is controlled to imprint the desired indicia on the labels 1.

The precise control of these elements depends on the particular label material being used, and it is imperative, therefor, that the microprocessor 14 receive information which precisely specifies the labels 1 on the spool 20. Label specifications are received by the microprocessor 14 from a sensor board 15 that is coupled to a memory chip 26 on the label spool 20 as further described below. The sensor board 15 also receives input from sensors 17, 19, 21, and 23 to relay information to the microprocessor 14 concerning other aspects of the printing operation such as print head position, label supply status and ribbon supply status.

Figure 4:
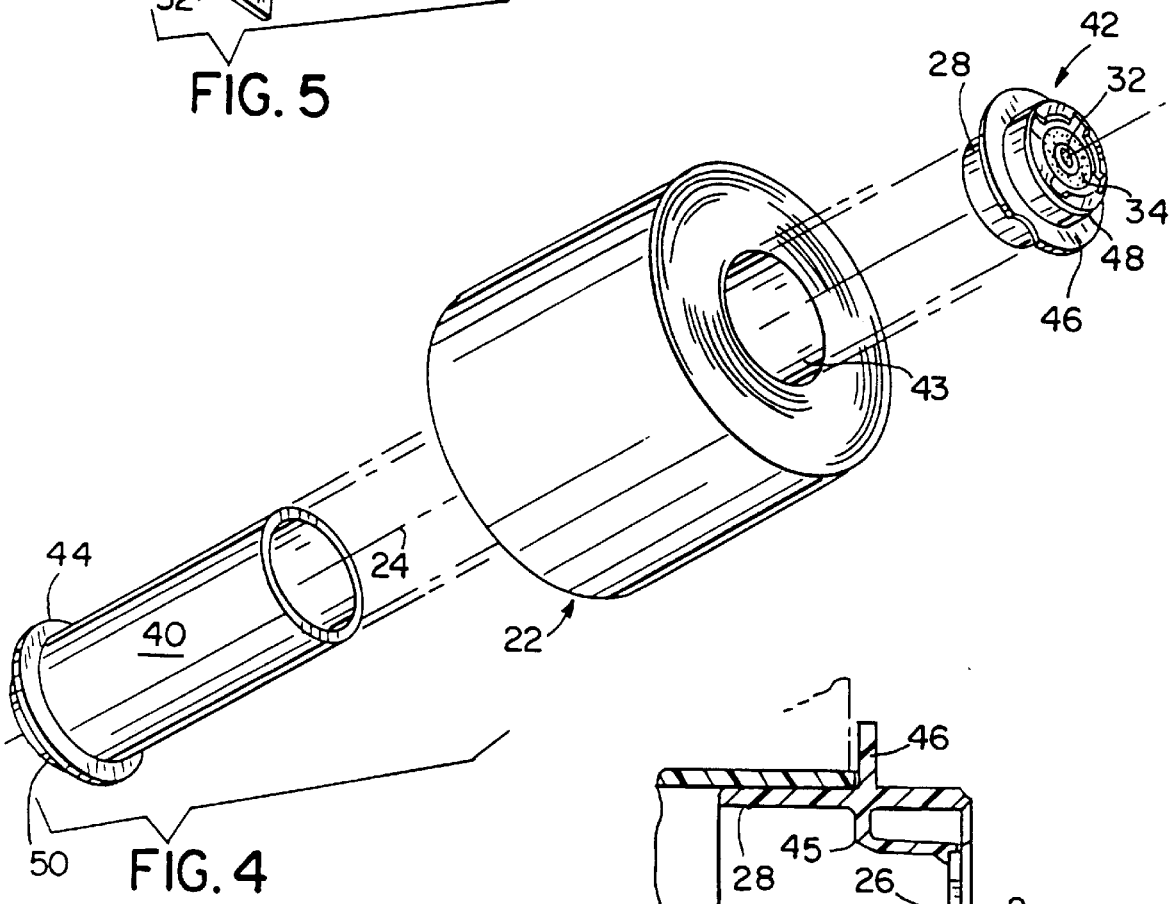
FIG. 4 is an exploded perspective view of a spool which forms part of the printer shown in FIG. 1.

Referring particularly to FIG. 4, the spool 20 is formed by two molded plastic parts, 40 and 42. The first part is a circular cylindrical core 40 which extends through an opening 43 in the roll of labeling media 22. A flange 44 is formed on the end of the core 40 and engages one side of the labeling media 22 to retain it in place. The other element of the spool 20 is a cap 42 which has a circular cylindrical shaft 28 that fits snugly in the open end of the core 40. A flange 46 extends radially outward around the cap 42 and it engages the other end of the roll of labeling media 22. Hubs 48 and 50 extend laterally outward from each end of the spool 20 and these hubs are received in a pair of spaced receptacles 52, shown in FIGS. 7 and 8, formed part of an assembly 51 which is mounted in the receptacle cavity 12. One of the receptacle portions of the assembly 51 is slidably moveable to accommodate different spool 20 lengths.

Figure 5:
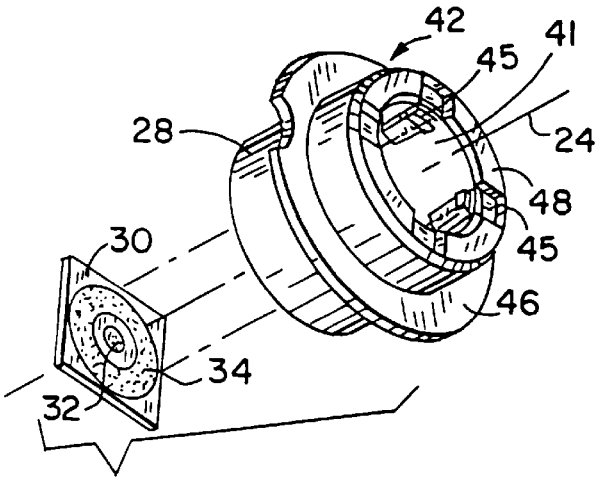
FIG. 5 is an exploded perspective view of a cap which forms part of the spool in FIG. 4.
Figure 6:
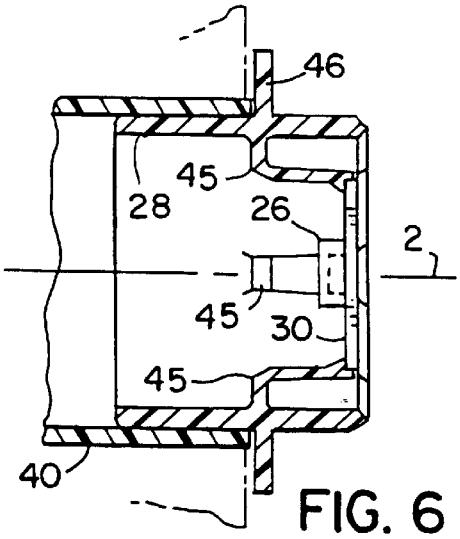
FIG. 6 is a view in cross section of the assembled cap in FIG. 5.

Referring particularly to FIGS. 5 and 6, the cap 42 serves as a housing for a memory chip 26 that stores information specifying the size and type of labels carried by the spool 20. This stored information is needed by the microprocessor 14 in the printer 10, and an important aspect of the present invention is the manner in which this information is coupled from the memory chip 26 to the microprocessor 14.

The memory chip 26 is mounted on a square printed circuit board 30 which snaps into place in an opening 41 formed in the end of the cap 42. A set of four retainer arms 40 are integrally formed on the inside of the cap 42 and they snap into place to hold the circuit board 30 in position. The memory chip 26 is soldered in place and is disposed on the inside surface of the circuit board 30. Two leads on the memory chip 26 connect through openings in the circuit board 30 to a pair of circular, concentric electrical contacts 32 and 34 formed on the outer surface of the circuit board 30. As shown best in FIG. 4, the two electrical contacts 32 and 34 are concentric about the axis 24 of the spool 20. Although a pair of electrical contacts and corresponding leads are shown, more than two contacts and a like number of leads may be used as the application requires.

Figure 8:
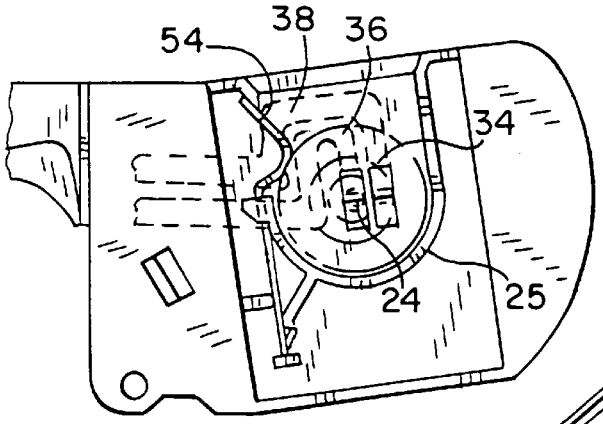
FIG. 8 is a view in cross section of structure for receiving the spool of FIG. 4.
Figure 7:
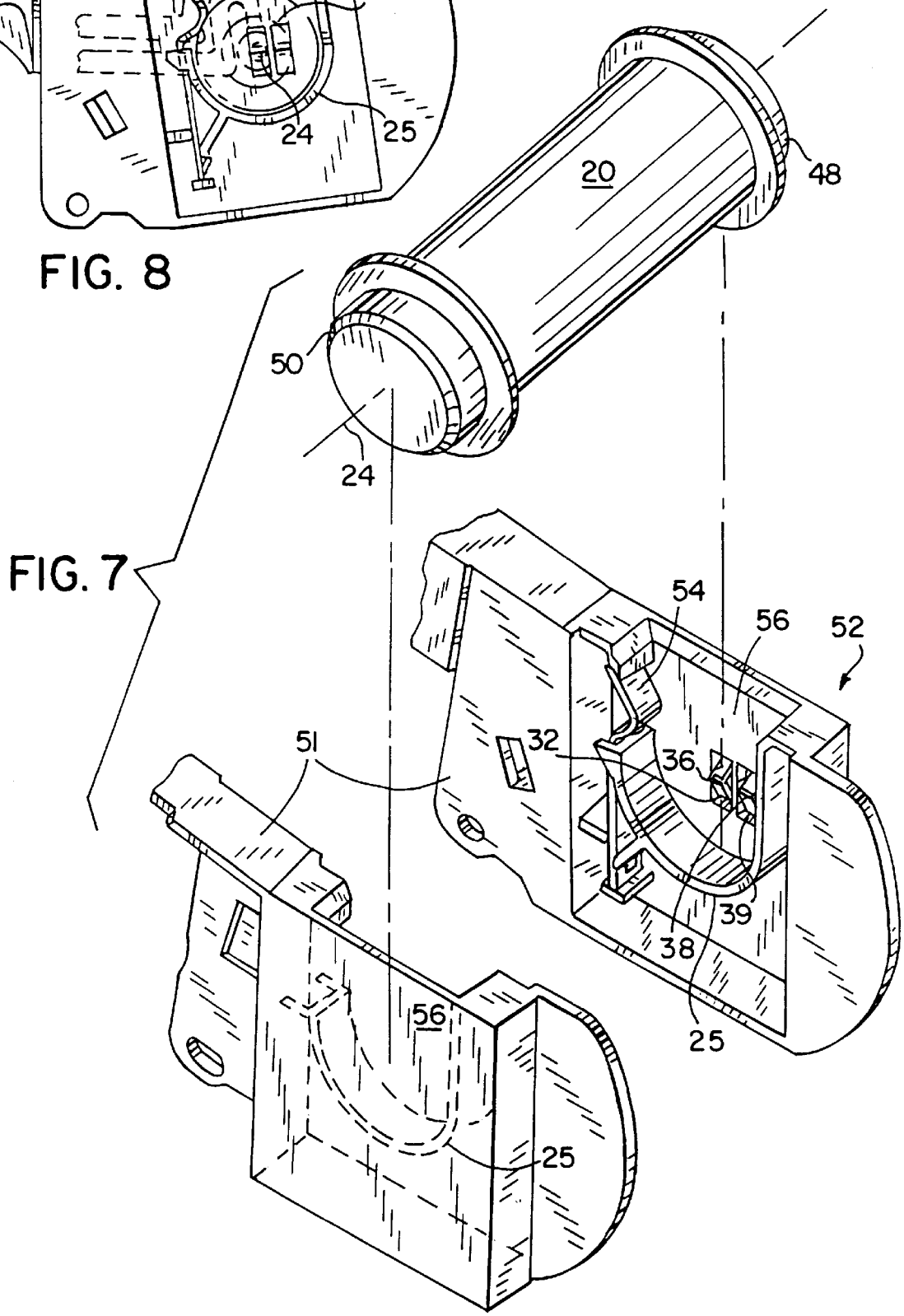
FIG. 7 is a partial perspective view of structure for receiving the spool of FIG. 4.

Referring particularly to FIGS. 7 and 8, when the spool 20 is snapped into place in the printer 10, the hubs 48 and 50 are received in a well defined by a curved wall 25. A retainer spring 54 is deformed as the spool 20 is inserted into the well, and it springs back into place when the hub is in position to hold the hub in the well during operation of the printer. The spool 20 is removed from the well 25 by pulling its hubs 48 and 50 out of the receptacles against the spring force of the retainer springs 54.

As shown in FIGS. 7 and 8, an end wall 56 is formed on the left receptacle 52 such that the end of the cap 42 abuts it when the spool 20 is inserted. A pair of openings, 37 and 39, are formed in the end wall 56, in which a pair of stationary spring contacts, 36 and 38, extend through and engage the end of the cap 42. The stationary spring contacts 36 and 38 are electrically coupled to the sensor board 15 by conductors (not shown). The sensor board 15 is then coupled to the microprocessor 14.

The spring contact 36 is aligned with the spool axis 24 to engage the central contact 32 on the circuit board 30, and the spring contact 38 is spaced therefrom to engage the annular shaped contact 34. Regardless of the orientation of the spool 20 about its axis 24, both spring contacts 36 and 38 will make continuous electrical connection with the concentric contacts 32 and 34 on the end of the spool 20. As a result, continuous electrical connection between the memory chip 26 on the spool 20 and the microprocessor 14 in the printer 10 is maintained.

While there has been shown and described what are at present considered the preferred embodiment of the invention, it will be apparent to those skilled in the art that various changes and modifications can be made therein without departing from the scope of the invention defined by the appended claims.

We claim:

1. A spool for supporting a roll of print media in a hand held printer, the combination comprising:

a cylindrical core which extends through an opening in the roll of print media and enables the print media to unwind about a roll axis as the print media is consumed by the hand held printer;

hubs formed on two ends of the cylindrical core and shaped to fit in receptacles in the hand held printer;

memory means mounted in the spool and located near one hub;

a plurality of electrical contacts formed on the end of said one hub and positioned to engage a like number stationary contacts in one of the printer receptacles when the spool is mounted therein; and electrical connections between said electrical contacts and said memory means; and wherein the memory means stores information specifying the print media supported by the spool.

2. The spool as recited in claim 1, in which said plurality of electrical contacts is a pair of electrical contacts.

3. The spool as recited in claim 1, in which the two electrical contacts are concentric about the roll axis such that the spool may be inserted in the printer receptacles at any orientation about the roll axis.

4. The spool as recited in claim 1, in which a printed circuit board is mounted in an opening formed in the end of said one hub, said electrical contacts are formed on one side of the printed circuit board, the memory means is mounted on the other side of the printed circuit board, and said electrical connections are formed by conductive paths on the printed circuit board.

5. The spool as recited in claim 1, in which flanges are formed on both ends of the cylindrical core to retain the roll of print media in place on the spool.

6. The spool as recited in claim 5, in which said one hub and the adjacent flange are formed as an integral cap which is fastened to the cylindrical core.

7. The spool as recited in claim 6, in which a printed circuit board is mounted in an opening formed in the end of said one hub, said electrical contacts are formed on one side of the printed circuit board, the memory means is mounted on the other side of the printed circuit board, and said electrical connections are formed by conductive paths on the printed circuit board.

* * * * *